US005921317A

United States Patent [19]

Dewprashad et al.

[11] Patent Number: 5,921,317

[45] Date of Patent: Jul. 13, 1999

[54] COATING WELL PROPPANT WITH HARDENABLE RESIN-FIBER COMPOSITES

[75] Inventors: Brahmadeo T. Dewprashad, Lawton; Jimmie D. Weaver, Duncan; Steven F. Wilson, Duncan; Bhadra D. Desai, Duncan, all of Okla.

[73] Assignee: Halliburton Energy Services, Inc.

[21] Appl. No.: 08/911,672

[22] Filed: Aug. 14, 1997

[51] Int. Cl.[6] ..... E21B 43/04

[52] U.S. Cl. ..... 166/208; 166/308; 523/131

[58] Field of Search ..... 166/280, 308; 523/131, 402, 417, 426

[56] References Cited

U.S. PATENT DOCUMENTS

| | | | |
|---|---|---|---|
| 4,532,052 | 7/1985 | Weaver et al. | 166/275 |
| 4,829,100 | 5/1989 | Murphey et al. | 523/131 |
| 5,330,005 | 7/1994 | Card et al. | 166/280 |
| 5,439,055 | 8/1995 | Card et al. | 166/280 |
| 5,501,274 | 3/1996 | Nguyen et al. | 166/280 |
| 5,501,275 | 3/1996 | Card et al. | 166/280 |
| 5,582,249 | 12/1996 | Caveny et al. | 166/281 |
| 5,775,425 | 7/1998 | Weaver et al. | 166/280 |

*Primary Examiner*—William Neuder
*Attorney, Agent, or Firm*—Robert A. Kent

[57] ABSTRACT

Methods of continuously forming and suspending hardenable resin-fibrous material composite coated proppant in a carrier liquid are provided. The methods basically comprise dissolving a hardenable resin composition and a fibrous material in a solvent which is insoluble in the carrier liquid, pumping the carrier liquid, combining uncoated proppant with the carrier liquid as the carrier liquid is pumped and combining the hardenable resin composition-fibrous material solution with the carrier liquid as the carrier liquid is pumped whereby the proppant is coated with a hardenable resin composition-fibrous material composite.

25 Claims, No Drawings

COATING WELL PROPPANT WITH HARDENABLE RESIN-FIBER COMPOSITES

BACKGROUND OF THE INVENTION

1. Field of the Invention.

The present invention relates generally to coating well proppant with a hardenable resin-fiber composite, and more particularly, to methods of continuously forming and suspending such composite coated proppant in a carrier liquid.

2. Description of the Prior Art.

Various methods have been developed for consolidating particulate solids such as sand into hard permeable packs in subterranean zones. The methods are useful in preventing loose or incompetent sand in subterranean formations from being produced from the formations along with formation fluids such as hydrocarbons and/or water. The consolidated particulate solid packs reduce or prevent the migration and production of sand with produced fluids when the consolidated solid packs are located between the producing formation and the well bore penetrating the formation.

A successful technique which has heretofore been utilized for forming a consolidated permeable particulate solid pack in a formation adjacent to a well bore comprises coating sand with a hardenable resin composition on the surface, suspending the coated sand in a viscous carrier liquid and then pumping the suspension by way of the well bore into the formation whereby the coated sand is deposited therein. The hardenable resin composition on the deposited sand is caused or permitted to harden whereby a consolidated permeable particulate solid pack is formed between the well bore and loose or incompetent sands in the formation.

Wells producing hydrocarbons are often stimulated by hydraulic fracturing treatments. In such hydraulic fracturing treatments, a viscous liquid (also referred to as a fracturing liquid or fluid) is pumped into a producing zone to be fractured at a rate and pressure such that one or more fractures are formed in the zone. Particulate solids for propping the fractures, commonly referred to in the art as "proppant," are suspended in a portion of the fracturing fluid so that the proppant is deposited in the fractures when the fracturing fluid is caused to revert to a thin fluid and return to the surface. The proppant functions to prevent the fractures from closing whereby conductive channels are formed through which produced fluids can readily flow.

In order to prevent the subsequent flow-back of proppant as well as loose or incompetent sand in the fractured zone with fluids produced therefrom, at least a portion of the proppant has heretofore been coated with a hardenable resin composition which is caused to harden and consolidate the proppant in the zone. Typically, the resin composition coated proppant is deposited in the fractures after a larger quantity of uncoated proppant material has been deposited therein. That is, the last portion of the proppant deposited in each fracture, referred to in the art as the "tail-in" portion, is coated with the hardenable resin composition. Upon the hardening of the resin composition, the tail-in portion of the proppant is consolidated into a hard permeable pack having sufficient compressive strength to prevent unconsolidated proppant and formation particulate solids from flowing out of the fractures with produced fluids.

While the hardenable resin compositions used in performing the above described procedures have successfully formed hard permeable consolidated particulate solid packs in subterranean zones, they often suffer from failures involving instability at high temperatures, a low resistance to stress cycling brought about by varying produced fluid flow rates, crushing under fracture closure stress and the like which result in proppant flowback, etc. In addition, due to the relatively high quantities of hardenable resin composition required and the high costs thereof, the particulate solids consolidation procedures utilized have involved high costs.

Recently, fibers have been mixed with proppant and the mixture has been deposited in fractures. The fibers function to inhibit the flow-back of proppant with produced fluids by filling channels or void spaces in the proppant pack with fibers thereby inhibiting the movement of proppant and formation particulate solids through the propped fracture. The proppant fiber mixture has also been consolidated by pumping a hardenable resin composition into the fractures containing a proppant and fiber mixture and causing the resin composition to harden whereby the mixture is consolidated into a hard permeable pack. The incorporation of fibrous material in the hardenable resin composition utilized to consolidate particulate solids is advantageous in that the consolidated solids have a greater thermal stability, a greater resistance to stress cycling, increased tensile, flexural and compressive strengths and decreased shrinkage. Also, the presence of the fibers reduces the quantity of resin composition required which results in a cost savings as well as increased consolidated particulate solid pack permeability.

Attempts have been made to incorporate fibers in hardenable resin compositions used to coat particulate solids utilizing continuous particulate solid suspension and coating techniques. However, the addition of fibers to a hardenable resin composition results in poor coating of proppant in a viscous carrier or fracturing liquid.

Thus, there are needs for methods of continuously forming and suspending hardenable resin composition-fibrous material composite coated particulate solids in carrier liquids for use in treating subterranean producing zones penetrated by well bores.

SUMMARY OF THE INVENTION

The present invention provides methods of continuously forming and suspending hardenable resin-fibrous material composite coated particulate solids or proppant in a viscous carrier or fracturing liquid which meet the needs described above and overcome the deficiencies of the prior art. The methods basically comprise the steps of dissolving a hardenable resin composition and a fibrous material both of which are insoluble in the carrier or fracturing liquid in a solvent which is soluble in the carrier or fracturing liquid to thereby form a hardenable resin composition-fibrous material solution, pumping the carrier or fracturing liquid, suspending uncoated particulate solids or proppant in the carrier or fracturing liquid as the liquid is pumped, and combining the hardenable resin composition-fibrous material solution with the carrier or fracturing liquid containing the suspend ed particulate solids or proppant as the liquid is pumped. The carrier or fracturing liquid extracts the solvent from the hardenable resin composition-fibrous material solution whereby the particulate solids or proppant are coated with the remaining hardenable resin composition-fibrous material composite.

The methods are particularly suitable for use in forming consolidated particulate solid packs in subterranean zones to prevent the production of loose or incompetent formation sands with fluids from the zones and/or to form consolidated proppant packs in fractures formed in the zones.

It is, therefore, a general object of the present invention to provide methods of continuously coating well proppant with a hardenable resin-fiber composite.

Other and further objects, features and advantages of the present invention will be readily apparent to those skilled in the art from a reading of the description of preferred embodiments which follows.

DESCRIPTION OF PREFERRED EMBODIMENTS

As mentioned above, when fibers are mixed with particulate solids and the mixture is consolidated by a hardened resin composition into a hard permeable pack, the consolidated solid pack has a greater thermal stability, a greater resistance to stress cycling, increased tensile, flexural and compressive strengths and decreased shrinkage. When one or more of such consolidated particulate solid packs are utilized in a subterranean zone, the flow-back of portions of the particulate solids in the packs as well as formation fines is reduced or prevented. Also, the presence of the fibers in the resin composition reduces the quantity of resin composition required which results in a cost saving as well as increased consolidated particulate solid pack permeability.

Heretofore, attempts to continuously form and suspend hardenable resin composition-fibrous material composite coated particulate solids or proppant in a viscous carrier liquid or fracturing liquid have been unsuccessful in that the presence of the fibrous material in the resin composition prevents the resin composition from adequately coating the particulate solids or proppant in the carrier or fracturing liquid. The term "particulate solids" is used hereinafter to mean either particulate solids or proppant and the term "carrier liquid" is used hereinafter to mean either carrier liquids or fracturing liquids.

By the present invention, methods are provided for continuously forming and suspending hardenable resin composition-fibrous material composite coated particulate solids in a viscous carrier liquid which result in both the fibers and the solids being coated and consolidated by the hardenable resin composition. The methods are basically comprised of the steps of dissolving a hardenable resin composition and a fibrous material both of which are insoluble in the carrier liquid in a solvent which is soluble in the carrier liquid to thereby form a hardenable resin composition-fibrous material solution. The carrier liquid is pumped into a well bore and uncoated particulate solids are combined with at least a portion of the carrier liquid as the carrier liquid is pumped. The hardenable resin composition-fibrous material solution is also combined with the portion of the carrier liquid containing the particulate solids as the carrier liquid is pumped whereby the carrier liquid extracts the solvent from the hardenable resin composition-fibrous material solution and the particulate solids are coated with the remaining hardenable resin composition and fibrous material composite. The fibrous material remains dissolved in the resin composition until the resin composition is caused to harden whereupon the fibers reform within the coating of hardened resin on the proppant.

The fibrous material utilized preferably has a glass transition temperature above the glass transition temperature of the resin so that the composite formed remains vitreous at the temperatures encountered in subterranean zones.

A variety of carrier liquids can be utilized in accordance with the present invention including aqueous gels, foams or emulsions. The foams are comprised of water, one or more foaming agents and a gas such as nitrogen or air. The emulsions are comprised of water and a liquified, normally gaseous fluid such as carbon dioxide. Upon pressure release, the liquified gaseous fluid in an emulsion vaporizes and rapidly flows out of the treated formation.

The preferred carrier liquid for use in accordance with this invention is an aqueous gel comprised of water, a gelling agent for gelling the water and increasing its viscosity, and optionally, a cross-linking agent for cross-linking the gel and further increasing the viscosity of the liquid. The increased viscosity of the gelled or gelled and cross-linked liquid reduces fluid loss and allows the liquid to transport significant quantities of suspended particulate solids.

The water utilized to form the carrier liquid can be fresh water, salt water, brine or any other aqueous liquid which does not adversely react with other components utilized in accordance with this invention.

A variety of gelling agents can be utilized including hydratable polymers which contain one or more functional groups such as hydroxyl, cis-hydroxyl, carboxyl, sulfate, sulfonate, amino or amide. Particularly useful such polymers are polysaccharides and derivatives thereof which contain one or more of the monosaccharide units galactose, mannose, glucoside, glucose, xylose, arabinose, fructose, glucuronic acid or pyranosyl sulfate. Natural hydratable polymers containing the foregoing functional groups and units include guar gum and derivatives thereof, locust bean gum, tara, konjak, tamarind, starch, cellulose and derivatives thereof, karaya, xanthan, tragacanth and carrageenan. Hydratable synthetic polymers and copolymers which contain the above mentioned functional groups and which have been utilized heretofore include polyacrylate, polymethacrylate, polyacrylamide, maleic anhydride, methylvinyl ether polymers, polyvinyl alcohol and polyvinylpyrrolidone.

The preferred gelling agents for use in accordance with this invention are hydratable polysaccharide polymers selected from the group of hydroxyethylcellulose, carboxymethylcellulose, carboxymethylhydroxyethylcellulose, guar, hydroxypropylguar and carboxymethylhydroxypropylguar, with guar being the most preferred. Generally, the gelling agent used is combined with the water used in an amount in the range of from 0.1% to about 1% by weight of the water.

Examples of crosslinking agents which can be utilized to further increase the viscosity of the gelled carrier liquid are multivalent metal salts or other compounds which are capable of releasing multivalent metal ions in an aqueous solution. Examples of the multivalent metal ions are chromium, zirconium, antimony, titanium, iron (ferrous or ferric), zinc or aluminum. When used, the cross-linking agent is added to the gelled water in an amount in the range of from about 0.01% to about 1% by weight of the water.

The above described gelled or gelled and crosslinked carrier liquids typically also include gel breakers such as those of the enzyme type, the oxidizing type or the acid buffer type which are well known to those skilled in the art. The gel breakers cause the viscous carrier liquids to revert to thin fluids that can be produced back to the surface after they have been used to place particulate solids in a subterranean zone, e.g., to place hardenable resin composition-fibrous material composite coated particulate solids adjacent to or in a subterranean zone.

The carrier liquids can also include one or more of a variety of well known additives such as gel stabilizers, fluid loss control additives, clay swelling reducing additives (clay stabilizers), friction reducing additives, bactericides and the like.

The particulate solids utilized in accordance with the present invention are generally of a size such that formation particulate solids which migrate with produced fluids are prevented from being produced from a subterranean zone along with hydrocarbons and/or water. Various kinds of particulate solids can be utilized including sand, bauxite, ceramic materials, glass materials and the like. Generally, the particulate solids have a particle size in the range of from about 2 to about 400 mesh, U.S. Sieve Series. The preferred particulate material is sand having a particle size in the range of from about 10 to about 70 mesh, U.S. Sieve Series. Preferred sand particle size distribution ranges are one or more of 10–20 mesh, 20–40 mesh, 40–60 mesh or 50–70 mesh, depending on the particular size and distribution of formation solids to be screened out by the particulate solid pack.

The solvent utilized in accordance with the present invention to dissolve a hardenable resin composition and a fibrous material, both of which are insoluble in the carrier liquid, and which is itself soluble in the carrier liquid will vary depending upon the particular resin composition, fibrous material and carrier liquid utilized. When the carrier liquid is a preferred aqueous liquid as described above, a solvent selected from the group of aliphatic alcohols, ketones, glycol ethers, glycol ether esters and N-methylpyrrolidone can be utilized. Such solvents are soluble in aqueous liquids and dissolve the hardenable resin compositions and fibrous materials described below which are commercially available and insoluble in aqueous liquids.

The hardenable resin compositions referred to above are basically comprised of a hardenable organic resin, an aminosilane resin-to-particulate solid coupling agent and a resin hardening agent. Hardenable resin compositions are well known to those skilled in the art as is their use for consolidating particulate solids in subterranean formations and zones. A number of such compositions are described in detail in U.S. Pat. No. 4,042,032 issued to Anderson et al. on Aug. 16, 1977, U.S. Pat. No. 4,070,865 issued to McLaughlin on Jan. 31, 1978, U.S. Pat. No. 5,058,676 issued to Fitzpatrick et al. on Oct. 22, 1991 and U.S. Pat. No. 5,128,390 issued to Murphey et al. on Jul. 7, 1992, all of which are incorporated herein by reference. Generally, the hardenable organic resin composition is comprised of organic resin in an amount in the range of from about 20% to about 80% by weight of the composition, aminosilane coupling agent in an amount in the range of from about 0.1% to about 5% by weight of the composition and hardening agent in an amount in the range of from about 10% to about 75% by weight of the composition.

The hardenable organic resin used is preferably a liquid at 80° F. and is cured or hardened by heating or by contact with an internal or external hardening agent. Examples of hardenable organic resins which are suitable for use in accordance with this invention are polyepoxide resins and particularly novolak resins, polyester resins, phenol-aldehyde resins, urea-aldehyde resins, furan resins and urethane resins. These resins are available at various viscosities, depending upon the molecular weight of the resin. The preferred viscosity of the organic resin used in accordance with this invention is in the range of from about 1 to about 1,000 centipoises at 80° F. However, as will be understood, resins of higher viscosities can be utilized when mixed or blended with one or more diluents. Examples of suitable diluents for polyepoxide resins are styrene oxide, octylene oxide, furfuryl alcohol, phenols, furfural, liquid monoepoxides such as allyl glycidyl ether, and liquid diepoxides such as diglycidyl ether or resorcinol. Examples of such diluents for furfuryl alcohol resins, phenol-aldehyde resins and urea-aldehyde resins include, but are not limited to, furfuryl alcohol, furfural, phenol and cresol. Diluents which are generally useful with all of the various resins mentioned above include phenols, formaldehydes, furfuryl alcohol and furfural. Generally, polyepoxide resins are preferred for use in accordance with the present invention with a novalak epoxy resin being the most preferred.

The resin-to-particulate solid coupling agent is utilized in the hardenable resin composition to promote coupling or adhesion to particulate solids, both formation solids and particulate solids introduced into the subterranean zone to be treated. A particularly suitable such coupling agent is an aminosilane compound or a mixture of aminosilane compounds selected from the group consisting of N-β-(aminoethyl)-γ-aminopropyltrimethoxysilane, N-β-(aminoethyl)-N-β-(amino-ethyl)-γ-aminopropyltrimethoxysilane, N-β-(aminopropyl)-N-β-(aminobutyl)-γ-aminopropyltriethoxysilane and N-β-(amino-propyl)-γ-aminopropyltriethoxysilane. The most preferred coupling agent is N-β-(aminoethyl)-γ-aminopropyltrimethoxysilane.

When a hardening agent is utilized, it can be an internal hardening agent which is included in the hardenable resin composition or it can be an external hardening agent which is caused to contact the hardenable resin composition after it has coated particulate solids and it and the solids have been placed in a subterranean zone. An internal hardening agent is selected for use that causes the resin composition to harden after a period of time sufficient for the resin composition to be placed in the subterranean zone to be treated. Retarders or accelerators to lengthen or shorten the cure times are also utilized. When an external hardening agent is used, the hardenable resin composition-fibrous material composite coated particulate solids are first placed in the subterranean zone followed by an overflush solution containing the external hardening agent.

Suitable internal hardening agents for hardening resin compositions containing polyepoxide resins include, but are not limited to, amines, polyamines, amides and polyamides. A preferred such internal hardening agent is 4,4'diaminodiphenylsulfone. Examples of internal hardening agents which can be used with resin compositions containing furan resins, phenol-aldehyde resins, urea-aldehyde resins and the like are hexachloroacetone, 1,1,3-trichlorotrifluoroacetone, benzotrichloride, benzylchloride and benzalchloride.

Examples of external hardening agents for consolidating furan resins, phenol-aldehyde resins and urea-aldehyde resins are acylhalide compounds, benzotrichloride, acetic acid, formic acid and inorganic acids such as hydrochloric acid. Generally, external hardening agents selected from the group consisting of inorganic acids, organic acids and acid producing chemicals are preferred. The hardenable resin compositions can also include surfactants, dispersants and other additives well known to those skilled in the art.

Fibrous materials which are insoluble in aqueous carrier liquids but soluble in the above described solvents include cellulose acetate, cellulose acetate propionate and cellulose acetate butyrate. Of these, cellulose acetate is preferred.

As mentioned, a hardenable resin composition and a fibrous material of the types described above which are insoluble in the carrier liquid are dissolved in a solvent of the type described above which is soluble in the carrier liquid to thereby form a hardenable resin composition-fibrous material solution. Generally, the organic resin is dissolved in the solution in an amount in the range of from about 20% to about 95% by weight of the solution with the fibrous material being dissolved therein in an amount in the range of from about 0.1% to about 5% by weight of the solution.

When the carrier liquid utilized is pumped into a subterranean zone to be treated, uncoated particulate solid, e.g., sand, are combined with at least a portion of the carrier liquid as the carrier liquid is pumped and the hardenable resin composition-fibrous material solution is also combined with the carrier liquid. The solution containing resin and fibrous material in the amounts described above is generally added to the carrier liquid in an amount in the range of from about 0.1 to about 1 gallon per 100 pounds of particulate solids to be coated.

The carrier liquid extracts the solvent from the hardenable resin composition-fibrous material solution which leaves undissolved hardenable resin composition liquid containing dissolved fibrous material which coats onto the particulate solids while they are being carried by the carrier liquid. After the hardenable resin composition-fibrous material composite coated particulate solids are deposited in a subterranean zone and during the hardening of the resin composition, the dissolved fibrous material reforms and remains within the hardened resin coating whereby both the particulate solids and the fibrous material are encapsulated by the resin.

A preferred method of the present invention for continuously forming and suspending hardenable resin-fibrous material composite coated particulate solids in an aqueous carrier liquid is as follows. A hardenable polyepoxy resin and a cellulose acetate fibrous material are dissolved in a methyl ethyl ketone solvent in amounts of about 40% by weight of the solution and 2% by weight of the solution, respectively. The carrier liquid is pumped and uncoated particulate solids are combined with and suspended in at least a portion of the carrier liquid as it is pumped. The hardenable resin-fibrous material solution is also combined with the carrier liquid as the carrier liquid is pumped in an amount of about 0.188 gallons per 100 pounds of suspended particulate solids which results in the particulate solids being coated with a hardenable polyepoxide resin composition-cellulose acetate fibrous material composite as described above.

The creation of fractures in a subterranean zone utilizing a hydraulic fracturing process is well known. The hydraulic fracturing process generally involves pumping a viscous fracturing fluid containing suspended particulate proppant into the formation at a rate and pressure whereby fractures are created therein. The continued pumping of the fracturing fluid extends the fractures in the formation and carries the proppant into the fractures. Upon the reduction of the flow of the fracturing fluid and the reduction of pressure exerted on the zone, the proppant is deposited in the fractures and the fractures are prevented from closing by the presence of the proppant therein.

A method of the present invention for continuously forming and suspending hardenable resin-fiber composite coated proppant in an aqueous fracturing fluid and transporting the coated proppant into at least one fracture in a subterranean zone penetrated by a well bore whereby the coated proppant forms a hard permeable proppant pack in the fracture is comprised of the following steps. A hardenable resin composition and a fibrous material of the types described above which are insoluble in the fracturing fluid are dissolved in a solvent which is soluble in the fracturing fluid in the general amounts described above to thereby form a hardenable resin composition-fibrous material solution. The fracturing fluid is pumped into a subterranean zone and into the fracture by way of the well bore. Uncoated proppant is combined with and suspended in at least a portion of the fracturing fluid as the fracturing fluid is pumped and the hardenable resin composition-fibrous material solution is combined with the fracturing fluid as it is pumped in the general amounts described above whereby the proppant is coated with a hardenable resin composition-fibrous material composite. Thereafter, the hardenable resin composition-fibrous material composite coated proppant is deposited in the fracture and allowed to harden into a hard permeable pack in the fracture.

In order to further illustrate the methods of the present invention, the following examples are given.

EXAMPLE 1

A carrier liquid was prepared in the laboratory comprised of fresh water and a hydroxypropylguar gelling agent present in the water in an amount of about 4% by weight of water. The carrier liquid had a pH of about 10.5. Two 416 milliliter samples of the carrier liquid were placed in separate containers and 400 grams of 20/40 mesh sand were suspended in the carrier liquid in each container. A resin composition was then prepared comprised of novalak epoxy resin present in an amount of about 50% by weight of the composition, a coupling agent comprised of N-beta-(aminoethyl)-gamma-aminopropyltri-methoxysilane present in an amount of about 1.5% by weight of the composition and an internal hardening agent comprised of 4,4'diaminodiphenylsulfone present in an amount of about 17% by weight of the composition. The resin composition was dissolved in methyl ethyl ketone in an amount of about 30% by weight and 7.5 milliliters of the resulting composition were added to the first container of carrier liquid containing suspended proppant. A second methyl ethyl ketone solution of the above described resin composition was prepared and a cellulose acetate fibrous material was dissolved in the solution whereby the solution contained resin composition in an amount of about 50% by weight of the solution and cellulose acetate fibrous material in an amount of about 17% by weight of the solution. 7.5 milliliters of the solution were added to the second carrier liquid-sand suspension. After stirring, the coated sand from each sample was packed into a teflon lined chamber and cured for 20 hours at 250° F. The compressive strengths of the resulting consolidated sand packs were determined at room temperature and at 250° F. The results of these tests are set forth in the Table I below.

TABLE I

| | Compressive Strength, psi | |
|---|---|---|
| Sample Tested | Room Temperature | 250° F. |
| Resin Coated Sand Pack | 1032 | 328 |
| Resin and Fiber Coated Sand Pack | 1340 | 448 |
| Percent Increase Caused By Presence Of Fiber | 30% | 37% |

From Table I it can be seen that the consolidated sand pack containing the fibrous material had a compressive strength at room temperature which was 30% higher than the consolidated sand pack without fibrous material and a compressive strength at 250° F. which was 37% higher than the consolidated sand pack without fibers.

EXAMPLE 2

A carrier liquid was prepared in the laboratory comprised of fresh water and a hydroxypropylguar gelling agent present in the water in an amount of about 4% by weight of water. The carrier fluid had a pH of about 10.5. Two 261 milliliters samples of the carrier liquid were placed in separate containers and 250g of 20/40 mesh sand were suspended in the carrier liquid in each container. A resin composition was then prepared comprised of novalak epoxy resin present in an amount of about 50% by weight of the composition, a non-reactive diluent (butyl lactate) present in an amount of about 5% by weight of the composition, a coupling agent comprised of N-beta-(aminoethyl)-gamma-aminopropyltrimethoxysilane present in an amount of about 1.5% by weight of the composition and an internal hardening agent comprised of 4,4'diaminodiphenyl-sulfone present in an amount of about 25% by weight of the composition. The resin composition was dissolved in about 15% by weight of the composition and 10.4 milliliters of the resultant composition were added to the first container of carrier liquid containing suspended proppant. A second methyl ethyl ketone solution of the above described resin composition was prepared including a cellulose acetate butyrate fibrous material in an amount of about 2% by weight of the solution. 10.4 milliliters of the solution were added to the second carrier liquid-sand suspension. After stirring, the coated sand from each sample was packed into a teflon lined chamber and cured for 20 hours at 230° F. The compressive strengths of the resulting consolidated sand packs were determined at 230° F. The results of these tests are set forth in Table II below.

TABLE II

| Sample Tested | Compressive Strength, psi |
|---|---|
| Resin Coated Sand Pack | 1169 |
| Resin and Fiber Coated Sand Pack | 2024 |
| Percent Increase Caused By Presence of Fiber | 42 |

From Table II, it can be seen that the resin and fiber coated sand pack had a compressive strength which was 42% higher than the resin coated sand pack without fibrous material.

Thus, the present invention is well adapted to carry out the objects and attain the ends and advantages mentioned as well as those inherent therein. While numerous changes may be made by those skilled in the art, such changes are encompassed within the spirit of this invention as defined by the appended claims.

What is claimed is:

1. A method of continuously forming and suspending hardenable resin composition-fibrous material composite coated particulate solids in a carrier liquid comprising the steps of:

(a) dissolving a hardenable resin composition and a fibrous material both of which are insoluble in said carrier liquid in a solvent which is soluble in said carrier liquid to thereby form a hardenable resin composition-fibrous material solution;

(b) pumping said carrier liquid;

(c) combining uncoated particulate solids with at least a portion of said carrier liquid as said carrier liquid is pumped; and (d) combining said hardenable resin composition-fibrous material solution with said carrier liquid as said carrier liquid is pumped whereby said carrier liquid extracts said solvent from said hardenable resin composition-fibrous material solution and said particulate solids are coated with the remaining hardenable resin composition-fibrous material composite.

2. The method of claim 1 wherein said solvent utilized in accordance with step (a) is selected from the group of aliphatic alcohols, ketones, glycol ethers, glycol ether esters and N-methylpyrrolidone.

3. The method of claim 1 wherein said hardenable resin composition is comprised of a polyepoxide resin, an aminosilane and a hardening agent.

4. The method of claim 3 wherein said polyepoxide resin is a novalak epoxy resin.

5. The method of claim 4 wherein said aminosilane is N-beta-(aminoethyl)-gamma-aminopropyltrimethoxysilane.

6. The method of claim 5 wherein said hardening agent is 4,4'diaminodiphenylsulfone.

7. The method of claim 1 wherein said fibrous material is selected from the group of cellulose acetate, cellulose acetate propionate and cellulose acetate butyrate.

8. The method of claim 1 wherein said carrier liquid is an aqueous liquid.

9. The method of claim 1 wherein said carrier liquid is an aqueous gelled liquid comprised of water and a hydratable gelling agent.

10. The method of claim 9 wherein said hydratable gelling agent is a polysaccharide polymer selected from the group of hydroxyethylcellulose, carboxymethylcellulose, carboxymethylhydroxyethylcellulose, hydroxypropylguar and carboxymethylhydroxypropylguar.

11. The method of claim 9 which further comprises the step of combining a cross-linking agent with said carrier liquid.

12. A method of continuously forming and suspending hardenable resin-fibrous material composite coated particulate solids in an aqueous carrier liquid comprising the steps of:

(a) dissolving a hardenable polyepoxy resin composition and a cellulose acetate fibrous material in a methyl ethyl ketone solvent which is soluble in said carrier liquid to thereby form a hardenable resin composition-fibrous material solution;

(b) pumping said carrier liquid;

(c) combining uncoated particulate solids with at least a portion of said carrier liquid as said carrier liquid is pumped; and (d) combining said hardenable resin composition-fibrous material solution with said carrier liquid as said carrier liquid is pumped whereby said carrier liquid extracts said methyl ethyl ketone solvent from said hardenable resin composition-fibrous material solution and said particulate solids are coated with the remaining hardenable polyepoxide resin composition and cellulose acetate fibrous material composite.

13. The method of claim 12 wherein said hardenable polyepoxy resin composition is comprised of novalak epoxy resin, N-beta-(aminoethyl)-gamma-aminopropyltrimethoxysilane and 4,4'diaminodiphenylsulfone.

14. The method of claim 13 wherein said particulate solids are sand.

15. The method of claim 14 wherein said carrier liquid is an aqueous gel comprised of water and a polysaccharide polymer hydratable gelling agent.

16. A method of continuously forming and suspending hardenable resin-fiber composite coated proppant in an aqueous fracturing fluid and transporting said coated proppant into at least one fracture in a subterranean zone penetrated by a well bore whereby said coated proppant forms a hard permeable proppant pack in said fracture comprising the steps of:

(a) dissolving a hardenable resin composition and a fibrous material both of which are insoluble in said fracturing fluid in a solvent which is soluble in said fracturing fluid to thereby form a hardenable resin composition-fibrous material solution;

(b) pumping said fracturing fluid into said subterranean zone and into said fracture by way of said well bore;

(c) combining uncoated proppant with at least a portion of said fracturing liquid as said fracturing fluid is pumped; and (d) combining said hardenable resin composition-fibrous material solution with said fracturing fluid as said fracturing fluid is pumped whereby said fracturing fluid extracts said solvent from said hardenable resin composition-fibrous material solution and said proppant is coated with the remaining hardenable resin composition and fibrous material composite;

(e) causing the resulting hardenable resin composition-fibrous material composite coated proppant to be deposited in said fracture; and (f) allowing said coated proppant to harden into a hard permeable pack in said fracture.

17. The method of claim 16 wherein said solvent utilized in accordance with step (a) is selected from the group of aliphatic alcohols, ketones, glycol ethers, glycol ether esters and N-methylpyrrolidone.

18. The method of claim 17 wherein said hardenable resin composition is comprised of a polyepoxide resin, an aminosilane and a hardening agent.

19. The method of claim 18 wherein said polyepoxide resin is a novalak epoxy resin.

20. The method of claim 19 wherein said aminosilane is N-beta-(aminoethyl)-gamma-aminopropyltrimethoxysilane.

21. The method of claim 20 wherein said hardening agent is 4,4'diaminodiphenylsulfone.

22. The method of claim 21 wherein said fibrous material is selected from the group of cellulose acetate, cellulose acetate propionate and cellulose acetate butyrate.

23. The method of claim 22 wherein said fracturing fluid is comprised of water and a hydratable gelling agent.

24. The method of claim 23 wherein said hydratable gelling agent is a polysaccharide polymer selected from the group of hydroxyethylcellulose, carboxymethylcellulose, carboxymethylhydroxyethylcellulose, hydroxypropylguar and carboxymethylhydroxypropylguar.

25. The method of claim 24 which further comprises the step of combining a cross-linking agent with said fracturing fluid.

* * * * *